United States Patent [19]

Edström et al.

[11] 4,422,069

[45] Dec. 20, 1983

[54] SYSTEM FOR INDICATING AN EMERGENCY EXIT

[76] Inventors: Karl L. Edström, Batterivägen 60,, 951 00 Lulea, Sweden; Per A. W. Högström, 71 Duke St., London W1, England

[21] Appl. No.: 311,760

[22] Filed: Oct. 15, 1981

[30] Foreign Application Priority Data

Oct. 17, 1980 [SE] Sweden ..... 8007308

[51] Int. Cl.[3] ..... G08B 5/38; G08B 17/00; G08B 21/00

[52] U.S. Cl. ..... 340/691; 315/76; 362/20; 362/802; 340/654

[58] Field of Search ..... 340/691, 654, 540; 362/802, 183, 20; 315/86, 129, 76

[56] References Cited

U.S. PATENT DOCUMENTS 4,074,225 2/1978 Vandeweghe ..... 340/691

4,255,746 3/1981 Johnson et al. ..... 362/183

4,283,657 8/1981 Gordon et al. ..... 340/691

4,349,863 9/1982 Petersen ..... 362/183

*Primary Examiner*—Glen R. Swann, III

*Attorney, Agent, or Firm*—Curtis Ailes

[57] ABSTRACT

At least one, and preferably two, flashable lights are positioned near an exit door and are actuated in case of an emergency such as a fire or interruption of power. The lights are preferably located near the floor on opposite sides of the exit and are energized by emergency power supply batteries upon interruption of the main power supply. The main power supplied to the system may be interrupted by a fire detector device, and the system includes means for commencing the operation of the flashable lights upon any such interruption. Th flashable lights are preferably discharge tube photoflash lamps which are capable of emitting high intensity flashes.

7 Claims, 3 Drawing Figures

SYSTEM FOR INDICATING AN EMERGENCY EXIT

BACKGROUND OF THE INVENTION

The present invention relates to a system for guidance to the emergency exit in a building.

The object of the invention is to provide a system of the kind indicated above, that provides reliable guidance also in very heavily smoke filled spaces and that cannot be put out of operation by any type of cable fault, voltage interruption or the like.

The system according to the invention includes at least one flashable light located on a low level above the floor. A drive unit associated with the flashable light includes a trigger circuit and accumulator batteries. Means for detecting interruption of the supply voltage are also included. Suitably the level of the flashable lights above floor is 70 cm at most. Preferably two flashable lights are located on each side of an emergency door exit quite close to the floor. These flashable lights preferably have a drive unit in common.

The invention has the following advantages. In case of fire always the upper portion of a room is first filled with smoke, this fact forming the basis of the advice that one should try to leave a room that is filled with smoke by crawling. This, however, also implies that conventional emergency exit indication devices which are located above the emergency exit become invisible relatively fast due to the thickening smoke so that accordingly the emergency exit becomes difficult to find. If, in accordance with the invention, the flashable lights are located near the floor on each side of the emergency exit this problem is eliminated. Furthermore, the system according to the invention cannot be put out of operation in case of intermittent or complete interruption of the supply voltage since the drive unit includes a means for sensing such interruption and actuates the trigger circuit to automatically start the flashable light. The same effect is attained upon short circuiting of the voltage supply. Alarm signals from fire and smoke detectors can be fed to the drive unit by controlling the interruption of power on the supply leads, or on a separate signal wire.

SUMMARY OF THE INVENTION

The invention is carried out by a system for indicating an emergency exit in case of fire in a building, comprising at least one flashable light located near floor level adjacent to the emergency exit and having an associated drive unit including a trigger circuit and accumulator batteries, said drive unit being arranged for connection to a mains supply voltage power source, and means for sensing interruption of the supply voltage to the drive unit and operable to actuate the trigger circuit upon such interruption to thereby initiate the energization and flashing of said flashable light from said accumulator batteries.

The invention will now be described more closely below with reference to the attached drawings that illustrate an embodiment of a system according to the invention as combined with exit sign means.

DESCRIPTION OF PREFERRED EMBODIMENTS

Figure 1:
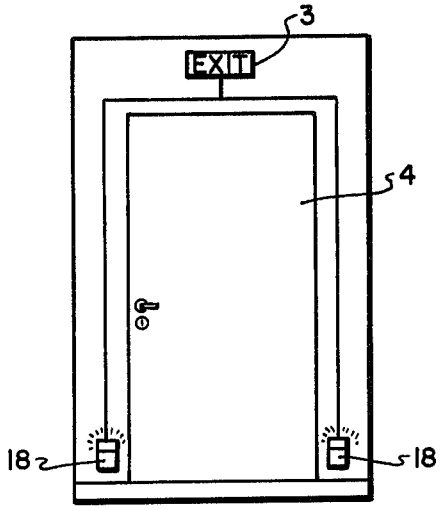
FIG. 1 illustrates an emergency door opening to which the system is applied.
Figure 2:
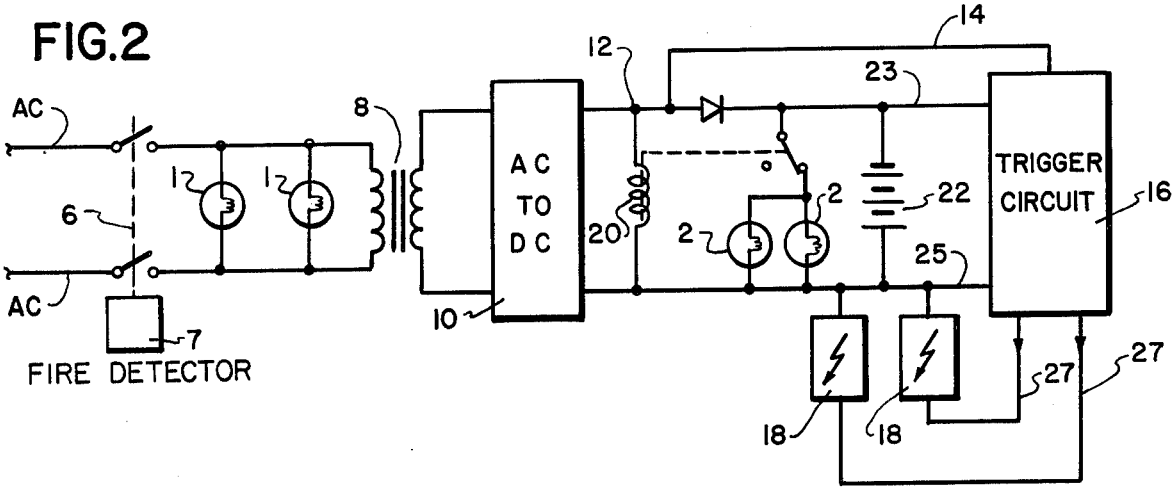
FIG. 2 is a schematic circuit diagram of a system according to the invention.

Mains-fed lamps 1 and battery-fed emergency lights 2 (FIG. 2) are included in an emergency sign 3 of conventional appearance located above a door opening 4 (FIG. 1). A switch 6 in the mains feed line is controlled by fire and smoke detector 7 for interrupting or pulsing the voltage supply in case of fire. If the voltage supply is pulsed, a corresponding pulsing light is obtained from the lamps 1 for indicating danger. Via a transformer 8 and AC-DC converter 10 said interruption or pulsing is sensed at the point 12, on the one hand, via a lead 14 by a trigger circuit 16 for flashable lights 18, and on the other hand, by a relay 20, that on voltage interruption connects the emergency lights 2 in parallel with accumulator batteries 22. The batteries 22 are connected to circuit 10 to be charged. The battery 22 is also connected to the trigger circuit 16 at connections 23 and 25.

The flashable lights 18 are located near floor level at each side of the door opening 4, preferably at a level of 70 cm at most over the floor, as shown in FIG. 1.

Figure 3:
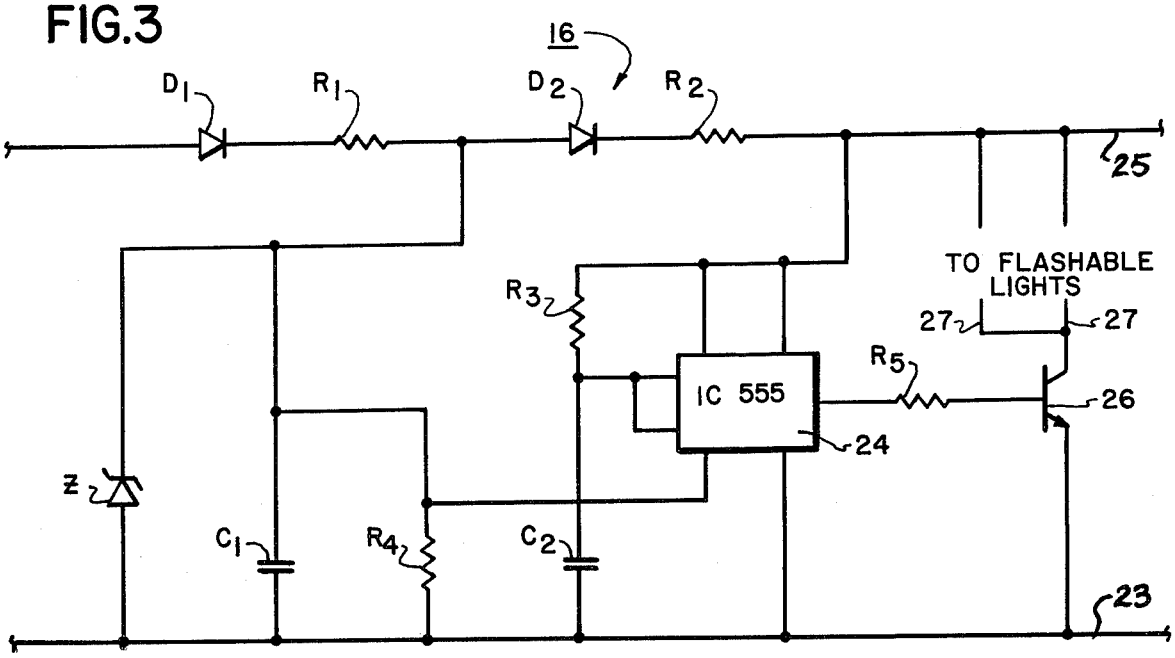
FIG. 3 is a schematic diagram of a trigger circuit included in the system.

The trigger circuit 16 can be of a conventional design easily realized by the man of the art and schematically shown in FIG. 3. Thus, it can include a voltage level sensing and time dependent IC circuit 24. The time constant is determined in known manner by means of a capacitor and resistor network so that the IC circuit 24 does not react to normal transient line voltage fluctuations but rather on the above mentioned pulsations. The output from the level sensing circuit 24 is connected to the base of a transistor 26, the collector-emitter path of which is connected in series with the accumulator batteries 22 across the flashable lights 18 through connections 27. The transistor 26 is thus brought to a conducting state via the level sensing circuit 24 in case of interruption or pulsation of the mains voltage so that the drive circuit of the flashable lights is actuated.

The components other than the integrated circuit 24 and the transistor 26 in FIG. 3 are all designated by circuit symbols, with the symbol R representing resistors, the symbol C representing capacitors, the symbol D representing diodes, and the symbol Z representing a Zener diode. While various circuit designs and circuit constants could be employed; by way of example, in one specific embodiment, the circuit components had the following specifications where the voltage input to the circuit from the AC to DC converter 10 was 24 volts:

R1 = 780 ohms
R2 = 47 ohms
R3 = 100,000 ohms
R4 = 47,000 ohms
R5 = 15 ohms
C1 = C2 = 10 microfarads Zener diode Z is rated at 7.5 volts at 1 watt dissipation.

Diodes D1 and D2 are rated at 1 amp, and 100 volts.

The batteries 22 consist of four series-connected nickel cadmium cells each rated at 4.8 volts.

If 24 volts AC is supplied to the circuit, instead of 24 volts DC, the only change is that the values of resistors R1 and R2 are changed to the following:

R1 = 380 ohms
R2 = 27 ohms

The flashable lights can be conventional photo flashes of the discharge tube type with a suitable frequency of discharge. In such photo flashes, ignition is obtained by a periodically built up electrostatic field via charge and discharge of a capacitor battery. These devices are capable of emitting high intensity flashes which are highly visible even through smoke or flames.

While this invention has been shown and described in connection with a particular preferred embodiment, it is apparent that various changes and modifications, in addition to those mentioned above, may be made by those who are skilled in the art without departing from the basic features of the invention. Accordingly, it is the intention of the applicant to protect all variations and modifications within the true spirit and valid scope of this invention.

We claim:

1. A system for indicating an emergency exit in case of fire in a building, comprising at least one flashable light located near floor level adjacent to the emergency exit and having an associated drive unit including a trigger circuit and accumulator batteries, said drive unit being arranged for connection to a mains supply voltage power source, and means for sensing interruption of the supply voltage to the drive unit and operable to actuate the trigger circuit upon such interruption to thereby initiate the energization and flashing of said flashable light from said accumulator batteries.

2. A system according to claim 1 in which a flashable light is positioned at each side of an emergency exit near the floor.

3. A system according to claim 2 in which the flashable lights are positioned on a level no more than 70 cm. above the floor.

4. A system according to claim 1 wherein said means for sensing interruption of supply voltage consists of a voltage level sensing circuit with such a time constant that said circuit does not react to normal transient supply voltage fluctuations, said trigger circuit being operable to control switch means for connecting the accumulator batteries to the flashable light.

5. A system according to claim 1 wherein said flashable light comprises a photoflash lamp of the discharge tube type which is capable of emitting high intensity flashes.

6. A system according to claim 1 wherein there is provided an illuminated emergency sign including lamps which are connected to be fed in parallel with said drive unit from the mains supply voltage power source, said emergency sign including emergency lamps and means for connecting said emergency lamps across said accumulator batteries upon interruption of the supply voltage.

7. A system according to any one of the preceding claims wherein the mains supply voltage connections to said drive unit include a fire-detector-controlled switch by means of which the supply voltage is interrupted in case of alarm.

* * * * *